United States Patent [19]

Pearce, Jr. et al.

[11] 4,186,987

[45] Feb. 5, 1980

[54] ELECTRICAL SOCKET CONNECTOR AND TERMINAL THEREFOR

[75] Inventors: Warren Pearce, Jr., Warren; Charles W. Ramsey, Niles, both of Ohio

[73] Assignee: General Motors Corporation, Detroit, Mich.

[21] Appl. No.: 953,412

[22] Filed: Oct. 23, 1978

[51] Int. Cl.[2] ..... H01R 9/12

[52] U.S. Cl. ..... 339/116 C; 339/217 S

[58] Field of Search ..... 339/8 R, 116 R, 116C, 339/94 N, 182 R, 182 RS, 217 R, 217 S, 192 R

[56] References Cited

U.S. PATENT DOCUMENTS

| | | | |
|---|---|---|---|
| 2,397,985 | 4/1946 | Schriefer | 200/27.5 |
| 2,645,759 | 7/1953 | Solari | 339/8 |
| 2,797,324 | 6/1957 | Midlock | 200/36 |
| 2,911,614 | 11/1959 | Davis | 339/182 |
| 3,193,636 | 7/1965 | Daniels | 200/51.12 |
| 3,202,959 | 8/1965 | Keller | 339/217 S |
| 3,271,729 | 9/1966 | Bakker | 339/217 |
| 3,336,567 | 8/1967 | Coldren | 339/192 |
| 3,553,635 | 1/1971 | Lundergan et al. | 339/258 |
| 3,665,509 | 5/1972 | Elkins | 339/12 V |
| 3,753,193 | 8/1973 | Teagno et al. | 339/256 R |
| 3,853,388 | 12/1974 | Heimbrock | 339/192 RL |
| 3,920,300 | 11/1975 | Kenny | 339/8 R |
| 3,957,331 | 5/1976 | Tantillo et al. | 339/6 R |
| 4,061,381 | 12/1977 | Smal | 339/8 P |
| 4,074,924 | 2/1978 | Lebecque | 339/20 |
| 4,123,131 | 10/1978 | Pearce et al. | 339/117 R |

FOREIGN PATENT DOCUMENTS 93843 4/1969 France .

OTHER PUBLICATIONS

"Straight-Through Connection," Mele et al, IBM Tech. Discl. bull. vol. 13, No. 11, 4/1971, p. 3341.

*Primary Examiner*—Eugene F. Desmond
*Attorney, Agent, or Firm*—F. J. Fodale

[57] ABSTRACT

An electrical socket connector is detachably connected to a post terminal having axially arranged multiple contacts which successively increase in size. The socket connector comprises a one-piece connector body having a plurality of longitudinal, vertically arranged, successively wider, cavities each containing an appropriately sized terminal and each having an appropriately sized longitudinal slot for the post terminal. The terminals are secured to lead wires and have forward contact portions comprising a pair of side rails which are connected by longitudinally spaced webs and which have inwardly displaced central portions between the webs which biasingly engage the post terminal contacts. The socket connector is sealed by a boot having flaps which close a rear assembly opening and a bottom wall passage which receives the post terminal. The socket connector also includes a connector lock for securing the socket connector to the post terminal.

6 Claims, 5 Drawing Figures

ELECTRICAL SOCKET CONNECTOR AND TERMINAL THEREFOR

This invention relates generally to electrical socket connectors and more particularly to an electrical socket connector for a post terminal having axially arranged multiple contacts and a terminal therefor.

U.S. Patent Application Ser. No. 920,135 filed by Robert D. Leonard, Jr. and Charles R. Nestor June 28, 1978 discloses an electrical socket connector which is connected to the post terminal of an oxygen sensor. The socket connector comprises a connector body carrying four vertical spaced terminals which are respectively welded to four axially arranged annular contacts of the oxygen sensor. The socket connector is sealed by a boot which includes a vent and the socket connector and boot form part of a pig tail. This arrangement is expensive to assemble and replace due to the permanent attachment of the socket connector terminals to the post terminal contacts.

The object of this invention is to provide an electrical socket connector which detachably connects to a post terminal having axially arranged multiple contacts.

Another object of this invention is to provide a detachable electrical socket connector for a multiple contact post terminal which utilizes a one-piece connector body and conventionally assembled terminals.

Yet another object of the invention is to provide a detachable electrical socket connector for a multiple contact post terminal which can be sealed by a boot and vented if necessary.

Yet another object of the invention is to provide a detachable electrical socket connector for a post terminal having axially arranged annular contacts which successively increase in diameter.

Still another object of the invention is to provide a terminal for a detachable electrical socket connector which is assembled in a connector body in a conventional manner and which when assembled engages a mating annular contact with high contact pressure for conducting low current signals.

A feature of the invention is the use of a stacked or tiered arrangement of terminals which are longitudinally assembled into a connector body in a conventional manner and which when assembled are insulated from each other with their respective contact portions vertically aligned.

Another feature of the invention is the use of a one-piece connector body designed to facilitate molding the body from a high temperature dielectric material such as a rigid silicone or phenolic.

Yet another feature of the invention is that the stacked terminals have elongated contact portions which accommodate longitudinal misalignments between the several terminals and post contacts due to manufacturing tolerances.

Other objects and features of the invention will become apparent to those skilled in the art as the disclosure is made in the following detailed description of a preferred embodiment of the invention as illustrated in the accompanying sheets of drawing in which.

Figures 1, 2:
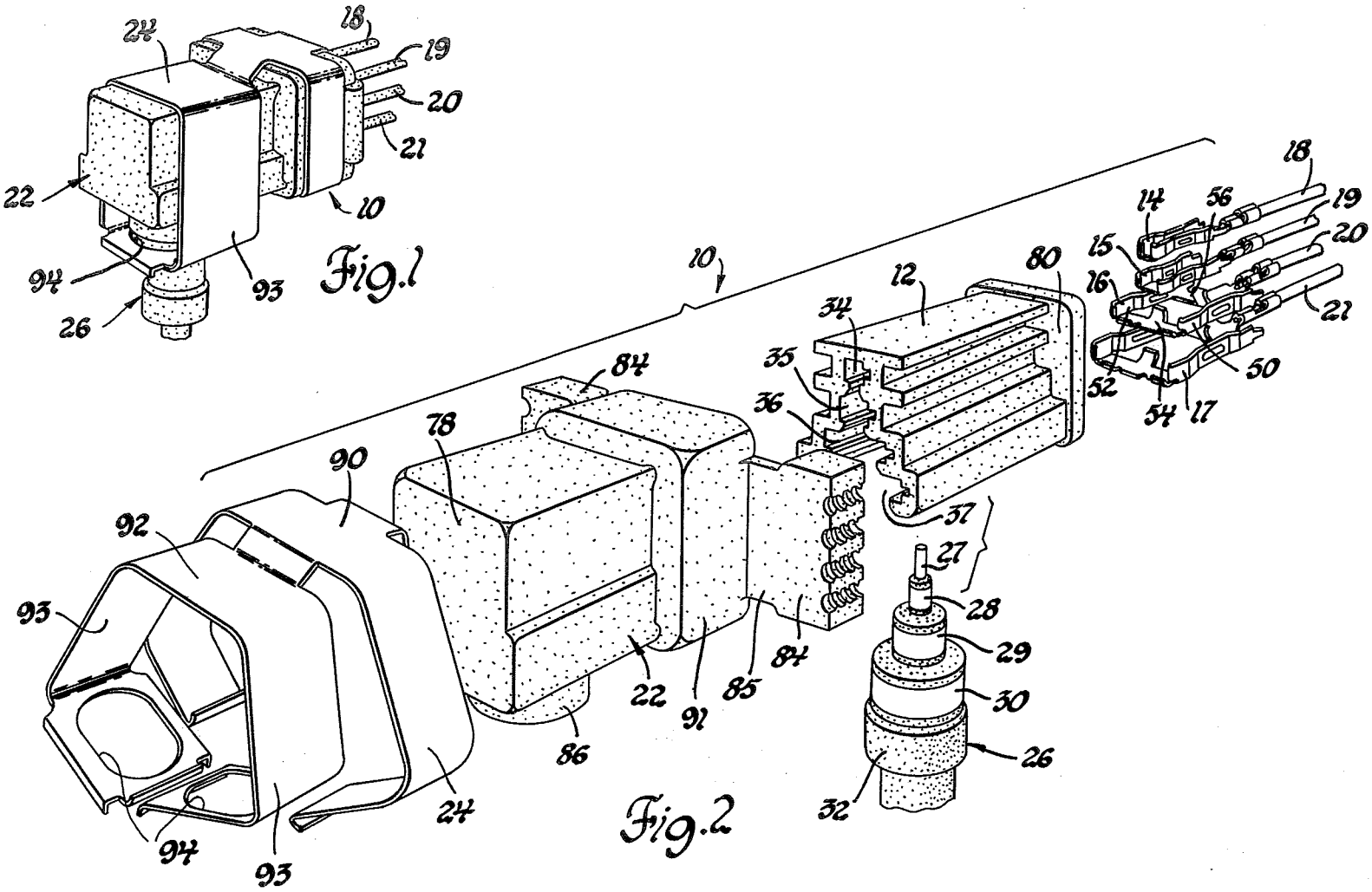
FIG. 1 is a perspective view of an electrical socket connector embodying this invention.
FIG. 2 is an exploded perspective view of the electrical socket connector shown in FIG. 1.

Referring now to the drawing, the electrical socket connector 10 comprises a one-piece molded connector body 12; terminals 14, 15, 16 and 17 attached to lead wires 18, 19 20 and 21 respectively; a seal boot 22 and a sheet metal connector lock 24. When assembled, the electrical socket connector 10 plugs onto a post terminal 26 having four axially arranged cylindrical contacts 27, 28, 29 and 30 which progressively increase in diameter and a lower collar 32 of insulating material.

Figure 3:
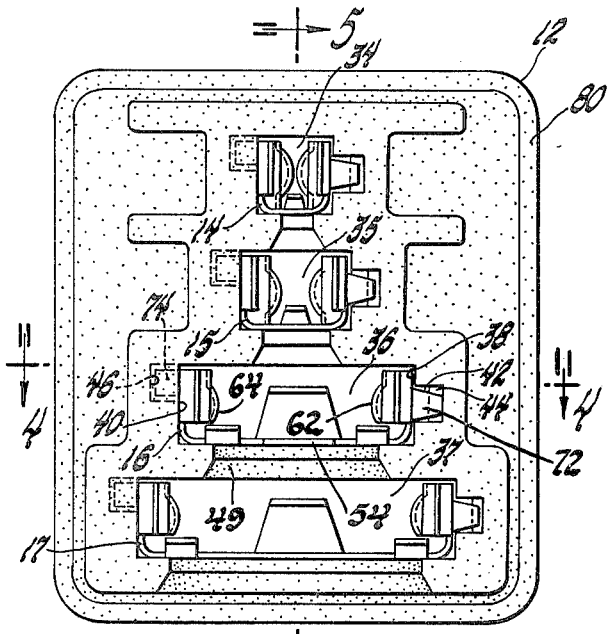
FIG. 3 is a front view of a subassembly of the electrical socket connector shown in FIGS. 1 and 2.
Figure 4:
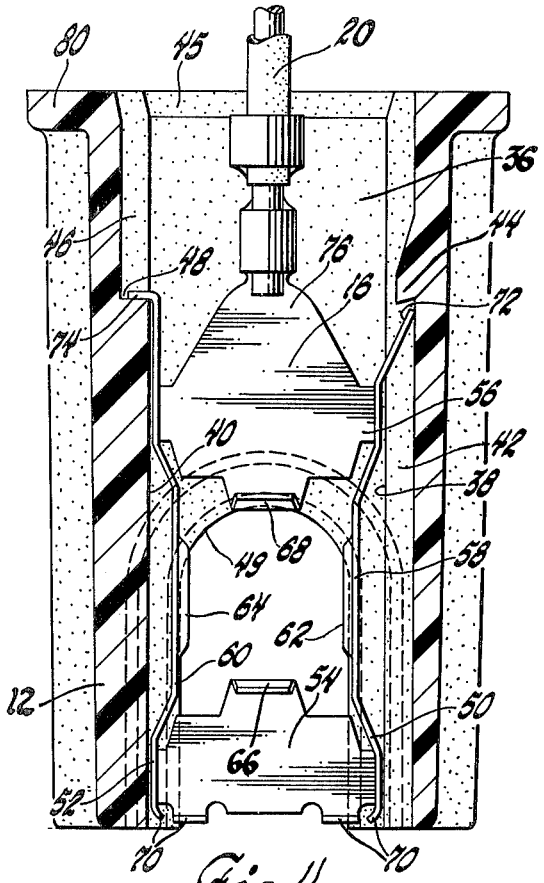
FIG. 4 is a section taken substantially along the line 4—4 of FIG. 3 looking in the direction of the arrows.
Figure 5:
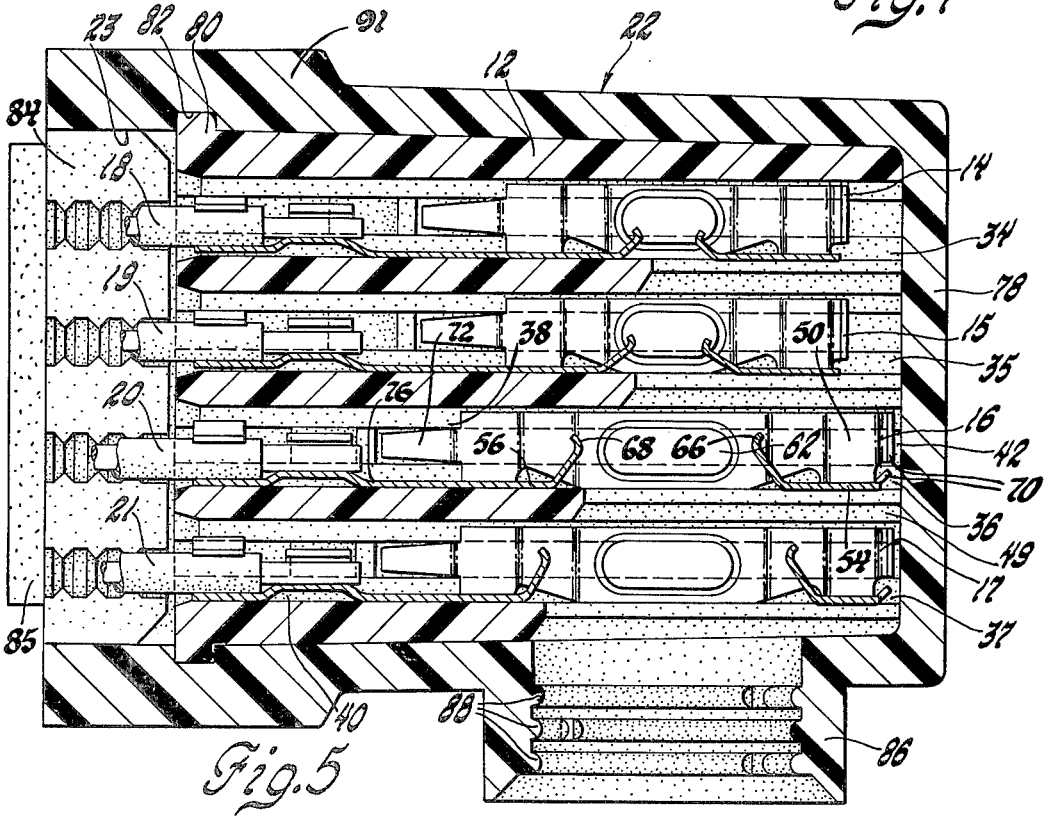
FIG. 5 is a section taken substantially along the line 5—5 of FIG. 3 looking in the direction of the arrows.

The connector body 12 is generally prismatic and has four longitudinal, vertically arranged, cavities 34, 35, 36 and 37 which are open at each longitudinal end of the connector body 12. These cavities successively increase in width from top to bottom and respectively receive the successively larger terminals 14, 15, 16 and 17 forming a subassembly which is illustrated in FIGS. 3, 4 and 5. The bottom wall for each cavity has a slot which extends part way back from the front of the connector body 12. These slots successively increase in width and length to accommodate the successively larger cylindrical contacts 27, 28, 29 and 30 in the respective cavities 34, 35, 36 and 37 when the socket connector 10 is plugged onto the post terminal 26.

The cavities 34, 35, 36 and 37 have substantially the same shape except for the width and slot sizes noted above. Consequently, a detailed description of the cavity 36 which is shown in section in FIG. 4 will suffice. The cavity 36 has a rectangular cross section defined by parallel side walls 38 and 40. The right side wall 38 (as viewed in FIGS. 3 and 4) has an open longitudinal groove 42 which extends for the entire length of the cavity and which contains a latch shoulder 44 near the rear opening 45 of the cavity. The left side wall 40 has an open longitudinal groove 46 which extends forward from the rear opening 45 a short distance to provide a stop shoulder 48 across from the latch shoulder 44. The bottom wall of the cavity 36 has a slot 49 extending part way back from the front of the connector body 12 which, as noted earlier, is narrower and shorter than the slot in the bottom wall of the cavity 37 below but wider and longer than the slot in the bottom wall of the cavity 35 above. It should be noted that the cavities including the bottom wall slots are shaped so that they can be formed with abutting cores. This feature facilitates molding the connector body 12 of high temperature dielectric materials which require higher molding pressures.

The terminals 14, 15, 16 and 17 are substantially the same and vary primarily in sizing each for its respective cavity. Consequently a detailed description of the terminal 16 and its relation to cavity 36 will suffice.

The terminal 16 has side rails 50 and 52 which are connected by a forward web 54 and a rearward web 56. The portions of the side rails 50 and 52 connected by the webs 54 and 56 are essentially channel shaped sections and accordingly the side rail portions are relatively stiff. These relatively stiff side rail portions respectively abut the side walls 38 and 40 of the cavity 36 to laterally support the terminal 16 in the cavity 38 on both sides of the central portions of the side rails 50 and 52 between the webs 54 and 56. These central portions are displaced inwardly toward each other providing outwardly deflectable resilient portions 58 and 60 which biasingly engage diametrically opposite sides of the cylindrical contact 29 with relatively high contact forces when the socket connector 10 is plugged onto the post terminal 26.

The resilient portions 58 and 60 also include dimples 62 and 64 which project over the slot 49 for effecting point contact with the cylindrical contact 29. The dimples 62 and 64 are elongated to accommodate vertical misalignments of the stacked terminals 14, 15, 16 and 17 and the cylindrical contacts 27, 28, 29 and 30 due to manufacturing tolerances.

The confronting edges of the webs 54 and 56 have integrally attached spring tongues 66 and 68 which are orthogonally related to the dimples 62 and 64 and which serve to guide the cylindrical contact 29 of the post terminal 26 into proper engagement with the dimples 62 and 64.

The side rails 50 and 52 and the front web 54 have small bent tabs 70 at their front ends to facilitate insertion of the terminal 16 (front end first) into the cavity 36 via the rear opening 45. The right side rail 50 (as viewed in FIGS. 3 and 4) has a rear latch finger 72 which snaps over the latch shoulder 44 to retain the inserted terminal 16 in the cavity 36. The left side rail 52 has a rear tab 74 which engages the stop shoulder 48 to prevent over insertion. The terminal 16 has a conventional attachment portion 76 (comprising core and insulation crimp wings) which is contiguous the rearward web 56 and which attaches the terminal 16 to the lead wire 20.

As noted above, the terminal 16 is assembled to the connector body 12 in a conventional manner by longitudinal insertion into the cavity 36 via the rear opening 45. The terminals 14, 15 and 17 are assembled in their respective cavities 34, 35 and 37 in the same manner to complete the subassembly shown in FIGS. 3, 4 and 5.

For a sealed arrangement, the subassembly is then inserted into the boot 22 via a rear assembly opening 23 until the forward end of the connector body 12 is adjacent a closed forward wall 78 of the seal boot. The connector body 12 has a flange plate 80 at its rear end which engages in an internal groove 82 in the rear assembly opening 23 to properly position the connector body 12 in the boot 22. The rear assembly opening 23 is then sealed by a pair of flaps 84 connected by integral straps 85 at the rear end of the boot 22. These flaps 84 are inserted into the rear assembly opening 23 behind the flange plate 80 and are slightly oversize so that the end surfaces of the flaps 84 are biased against the walls of the rear assembly opening 23 and the abutting faces of the flaps 84 are biased against each other. The bias produces an efficient sealing arrangement and also retains the flaps 84 in the closed position.

The flaps 84 have four channels in their abutting faces which accommodate the lead wires 18, 19, 20 and 21 and which are provided with radial sealing lips to seal against the lead wires.

The seal boot 22 has a passage through its bottom wall partly defined by an external collar 86 which is vertically aligned with the rearward portions of slot 29 and the other slots in the bottom walls of the cavities 34, 35 and 37 as shown in FIG. 5. The passage serves as a socket for the post terminal 26 and assists in guiding the post terminal 26 into proper engagement with the terminals 14, 15, 16 and 17.

The collar 86 has three internal ribs 88 which seal against the collar 32 of the post terminal 26. Electrical socket connector applications, such as oxygen sensor socket connectors, require a vent. For these applications, the vent may be provided by breaks in the ribs 88. The breaks are circumferentially spaced from each other so that the passage which admits ambient air is circuitous and thus acts as a barrier against dirt and the like. This method of providing a vent is conventional and disclosed in the pending U.S. patent application described in the introduction.

In some instances it may be desirable to lock the electrical socket connector 10 to the post terminal 26. This may be done by including the sheet metal connector lock 24 which comprises a mounting band portion 90 and a connector lock portion 92. The connector lock 24 is secured to the boot 22 by closing the open mounting band portion 90 around the rear end portion 91 of the boot 22 and locking it in the closed position by engaging the bent lips at the ends of the band portion 90.

The connector lock portion 92 comprises diverging resilient L-shaped flanges 93 longitudinally aligned with the boot passage partly defined by the collar 86. The angled end portions of the L-shaped flanges 93 have transversely elongated apertures 94. The apertures 94 align with each other and the boot passage when the resilient flanges 93 are manually squeezed toward each other. The socket connector 10 is plugged onto the post terminal 26 with the apertures 94 and boot passage aligned whereupon the resilient L-shaped flanges 93 are released. Upon release the apertures 94 misalign and their edge portions engage diametrically opposed portions of the post terminal 26 below the collar 32 to retain the socket connector 10 on the post terminal 26. At connector lock of this type is disclosed in pending U.S. Patent Application Ser. No. 859,727 entitled "Locking Shield for Electrical Terminal" filed by Robert G. Plyler et al Dec. 12, 1977.

We wish it to be understood that we do not desire to be limited to the exact details of construction shown and described, for obvious modifications will occur to a person skilled in the art.

What is claimed is:

1. An electrical socket connector for a post terminal having axially arranged multiple contacts comprising:

a molded one-piece connector body having a plurality of longitudinal cavities extending therethrough and defining openings at its front and rear ends, said connector body having a pair of exterior longitudinal walls and a partition wall between each adjacent pair of cavities, one of said exterior walls and each partition wall having a longitudinal slot extending therethrough which is open at the front end of the connector body, said longitudinal slots being in vertical alignment to receive a post terminal and dispose a portion thereof in each longitudinal cavity, a terminal disposed in each of said cavities, each terminal having a channel-shaped contact portion at one end and an attachment portion at an opposite end secured to a lead wire and being longitudinally insertable into its associated cavity via the opening at the rear end of the connector body, each said contact portion comprising a pair of side rails connected by forward and rearward webs longitudinally spaced from each other, said forward web spanning an associated one of said longitudinal slots adjacent the opening at the front end of the connector body, and said side rails having central portions between the webs which are displaced toward each other and project over the associated slot for engaging a portion of a post terminal when the post terminal is inserted into the connector body via the vertically aligned longitudinal slots.

2. An electrical socket connector for a post terminal having axially arranged multiple contacts which successively increase in size comprising:

a molded one-piece connector body having a plurality of longitudinal, vertically arranged, cavities extending therethrough and defining openings at its front and rear ends, said connector body having a pair of exterior longitudinal walls and a partition wall between each adjacent pair of cavities, said cavities successively increasing in width in a vertical direction toward one of said exterior walls, said partition walls and said one exterior wall being the respective bottom walls of the vertically arranged cavities, said bottom walls having vertically aligned longitudinal slots extending therethrough which are open at the front end of the connector body and which successively increase in size in said vertical direction to receive a post terminal and dispose successively larger cylindrical contacts in the respective vertically arranged cavities, terminals which successively increase in size retained in the respective vertically arranged cavities, each terminal being longitudinally insertable into its associated cavity via the opening at the rear end of the connector body and having a forward contact portion at one end and a rearward attachment portion secured to a lead wire, said contact portion comprising a pair of side rails connected by forward and rearward webs which are longitudinally spaced from each other and lie adjacent the bottom wall of the associated cavity, said forward web spanning the longitudinal slot through the bottom wall adjacent the opening at the front end of the connector body, and said side rails having inwardly displaced resilient portions between the webs which project over the longitudinal slot for engaging one contact of a post terminal having axially arranged multiple contacts when the post terminal is inserted into the connector body via the vertically aligned longitudinal slots.

3. An electrical socket connector for a post terminal having axially arranged multiple contacts comprising:

a molded one-piece connector body having a plurality of longitudinal, vertically arranged, cavities extending therethrough and defining openings at its front and rear ends, said connector body having a pair of exterior longitudinal walls and a partition wall between each adjacent pair of cavities, one of said exterior walls and each partition wall being a bottom wall for one of said vertically arranged cavities, each bottom wall having a longitudinal slot extending therethrough which is open at the front end of the connector body, said longitudinal slots being in vertical alignment to receive a post terminal and dispose a portion thereof in each longitudinal cavity, a terminal disposed in each of said cavities, each terminal having a channel-shaped contact portion at one end which is longitudinally insertable into its associated cavity via the opening at the rear end of the connector body, and an attachment portion at an opposite end secured to a lead wire, each said contact portion comprising a pair of side rails connected by forward and rearward webs longitudinally spaced from each other, said forward web lying adjacent the bottom wall of the associated cavity spanning the longitudinal slot therethrough adjacent the opening at the front end of the connector body, said side rails having central portions between the webs which are displaced inwardly toward each other and project over the longitudinal slot for engaging a portion of a post terminal when such is inserted into the connector body via the vertically aligned longitudinal slots, and a boot seal enclosing the connector body, said boot seal having a passage through its bottom wall which is aligned with rearward portions of the vertically aligned longitudinal slots for receiving the post terminal and guiding it into engagement with the terminals disposed in the vertically arranged cavities.

4. The electrical connector as defined in claim 3 wherein the boot seal has a rear opening through which the connector body is inserted into the seal boot and said seal boot having a pair of flaps which when closed seal the rear opening.

5. A terminal for an electrical socket connector which is detachably connectable to a post terminal and which includes a molded connector body which has a longitudinal cavity defining an opening at the rear end of the connector body and which has a front opening through a bottom wall of the cavity, said terminal comprising a forward contact portion which is longitudinally insertable into the cavity via the opening at the rear end of the connector body and a rearward attachment portion for securing the terminal to a lead wire, said contact portion comprising a pair of side rails connected by forward and rearward webs to provide relatively stiff longitudinally spaced channel sections for laterally supporting the terminal in the cavity, and said side rails having central portions between the channel sections which are displaced inwardly toward each other to provide outwardly deflectable resilient portions for biasingly engaging a post terminal at diametrically opposed locations when such is inserted between the side rails via the spacing between the webs.

6. In an electrical socket connector which is detachably connectable to a post terminal and which includes a molded connector body having a longitudinal cavity which has an opening at the rear end of the connector body, side walls and a bottom wall having an opening therethrough adjacent the front end of the connector body, and a terminal disposed in the cavity which has a forward contact portion and a rearward attachment portion securing the terminal to a lead wire, the combination comprising:

said contact portion having a pair of side rails connected by forward and rearward webs to provide relatively stiff longitudinally spaced channel sections which engage the side walls, for laterally supporting the terminal in the cavity, said side rails having central portions between the channel sections which are displaced inwardly toward each other to provide outwardly deflectable resilient portions for biasingly engaging a post terminal at diametrically opposed locations when such is inserted between the side rails via the opening through the bottom wall of the cavity and the spacing between the webs, each of said side walls having a longitudinal open groove providing a shoulder, and each of said side rails having laterally outwardly projecting portions rearwardly of the channel sections which engage the shoulder provided by the open groove in its associated side wall to retain the terminal in the cavity.

* * * * *